US008811831B2

(12) United States Patent
Wakana

(10) Patent No.: US 8,811,831 B2
(45) Date of Patent: Aug. 19, 2014

(54) PRINTING APPARATUS, PRINTING APPARATUS CONTROL METHOD, AND STORAGE MEDIUM STORING PROGRAM THEREOF

(75) Inventor: Toru Wakana, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 232 days.

(21) Appl. No.: 13/216,074

(22) Filed: Aug. 23, 2011

(65) Prior Publication Data

US 2012/0063831 A1 Mar. 15, 2012

(30) Foreign Application Priority Data

Sep. 14, 2010 (JP) ..... 2010-206139

(51) Int. Cl.
*G03G 15/00* (2006.01)
*B41J 13/10* (2006.01)

(52) U.S. Cl.
CPC ..... *B41J 13/106* (2013.01)
USPC ..... 399/15

(58) Field of Classification Search
USPC ..... 399/15
See application file for complete search history.

(56) References Cited

U.S. PATENT DOCUMENTS

| | | | | | |
|---|---|---|---|---|---|
| 3,936,180 | A * | 2/1976 | Willard et al. | 399/10 |
| 4,448,515 | A * | 5/1984 | Ishikawa | 399/15 |
| 4,561,765 | A * | 12/1985 | Masuda | 399/367 |
| 4,657,375 | A * | 4/1987 | Watanabe et al. | 399/15 |
| 4,766,464 | A * | 8/1988 | Watanabe et al. | 399/15 |
| 5,690,324 | A * | 11/1997 | Otomo et al. | 270/58.02 |
| 8,020,844 | B2 * | 9/2011 | Takenouchi et al. | 270/1.01 |
| 8,416,437 | B2 * | 4/2013 | Hosoda | 358/1.15 |
| 2002/0015180 | A1 * | 2/2002 | Tominaga | 358/1.15 |
| 2004/0066526 | A1 * | 4/2004 | Inoo et al. | 358/1.14 |
| 2007/0242962 | A1 * | 10/2007 | Yamamoto | 399/15 |
| 2007/0291286 | A1 * | 12/2007 | Utsunomiya et al. | 358/1.8 |
| 2008/0240742 | A1 * | 10/2008 | Tsukamoto | 399/15 |
| 2008/0259395 | A1 * | 10/2008 | Mori | 358/1.15 |
| 2009/0283966 | A1 * | 11/2009 | Morohashi | 271/279 |
| 2010/0097624 | A1 * | 4/2010 | Hirakawa | 358/1.12 |

FOREIGN PATENT DOCUMENTS

| | | | | |
|---|---|---|---|---|
| JP | 58162963 | A * | 9/1983 | G03G 15/00 |
| JP | 08194407 | A * | 7/1996 | G03G 21/00 |
| JP | 08197779 | A * | 8/1996 | G03G 15/01 |
| JP | 2004-255745 | A | 9/2004 | |
| JP | 2005-144797 | A | 6/2005 | |
| JP | 2005144797 | A * | 6/2005 | B41J 29/46 |
| JP | 2005153374 | A * | 6/2005 | G03G 21/00 |
| JP | 2005157015 | A * | 6/2005 | G03G 15/00 |
| JP | 2007-72299 | A | 3/2007 | |
| JP | 2008173877 | A * | 7/2008 | G03G 15/00 |

* cited by examiner

*Primary Examiner* — Nguyen Ha
(74) *Attorney, Agent, or Firm* — Fitzpatrick, Cella, Harper & Scinto

(57) ABSTRACT

The printing apparatus discharges, to a discharge unit, the sheet bearing the image printed by the print operation. The printing apparatus controls to execute sample printing according to accept a sample printing request during the print operation, and discharge a page obtained by the sample printing to a discharge destination different from the discharge unit. The printing apparatus discharges, to a second discharge location different from a first discharge location, a sheet subsequent to the sheet discharged to the first discharge location, according to accept the sample printing request during a print operation during which the sheet discharge unit discharges a sheet to the first discharge location of the discharge unit.

8 Claims, 9 Drawing Sheets

PRINTING APPARATUS, PRINTING APPARATUS CONTROL METHOD, AND STORAGE MEDIUM STORING PROGRAM THEREOF

BACKGROUND OF THE INVENTION

1. Field of the Invention

The present invention relates to a printing apparatus, a printing apparatus control method, and a storage medium storing a program thereof.

2. Description of the Related Art

Recently, printing apparatuses which perform mass printing often use a stacker capable of discharging, stacking, and holding a large number of printed materials such as 5,000 or 10,000 sheets. During mass printing, the state of the printing apparatus may change, and the print finish may differ from what the user wants. For example, when printed materials are copied a plurality of times, the state of the printing apparatus changes and the printing tint of even the same page changes as represented by pages 1501 and 1502 shown in FIG. 10. When printing results are stacked on the stacker, the physical structure of the stacker makes it difficult to confirm the printing results stacked on the stacker without stopping printing. This is because the stacker is comprises housing and the user cannot confirm printing results unless he opens the front door, stops printing, and takes out the contents.

To solve this, Japanese Patent Laid-Open No. 2005-144797 discloses a printing system having a sample printing function. When the user issues a sample printout instruction during printing, the sample printing function prints, on another sheet, an image to be printed on the next sheet, and discharges the printed sheet onto a discharge unit such as an escape tray. With this function, the user can easily inspect a printed material without stopping printing in the printing apparatus.

However, a conventional printing apparatus cannot easily specify a sheet having undergone sample printing out of sheets successively stacked on the stacker.

For example, the user cannot determine, among a large number of stacked sheets, the position of a sheet printed in almost the same tint as that of a sheet discharged onto the escape tray using the sample printing function. Assume that sample printing is executed for the 1,500th sheet when printing 2,000 sheets, and the user checks the sample printing result discharged onto the escape tray and detects a change of the tint. Even while the user confirms the sample printing result, the printing apparatus keeps stacking sheets in the stacker in order to prevent a decrease in productivity. Thus, the user cannot easily specify later the position of a sheet among stacked sheets on which the tint of the sheet printed by sample printing has changed.

SUMMARY OF THE INVENTION

An aspect of the present invention is to eliminate the above-mentioned problems with the conventional technology. The present invention provides a technique of easily recognizing a sheet among stacked sheets that has undergone sample printing in discharge.

The present invention in its first aspect provides a printing apparatus comprising: a printing unit configured to execute a print operation to print an image on a sheet; a sheet discharge unit configured to discharge, to a discharge unit, the sheet bearing the image printed by the print operation executed by the printing unit; a sample printing control unit configured to, according to accept a sample printing request during the print operation executed by the printing unit, control the printing unit to execute sample printing, and discharge a page obtained by the sample printing to a discharge destination different from the discharge unit; and a discharge control unit configured to, according to accept the sample printing request during a print operation during which the sheet discharge unit discharges a sheet to a first discharge location of the discharge unit, discharge, to a second discharge location different from the first discharge location, a sheet subsequent to the sheet discharged to the first discharge location.

The present invention in its first aspect provides a method of controlling a printing apparatus, comprising: a printing step of executing a print operation to print an image on a sheet; a sheet discharge step of discharging, to a discharge unit, the sheet bearing the image printed by the print operation executed in the printing step; a sample printing control step of, according to accept a sample printing request during the print operation executed in the printing step, controlling to execute sample printing in the printing step, and discharge a page obtained by the sample printing to a discharge destination different from the discharge unit; and a discharge control step of, according to accept the sample printing request during a print operation during which a sheet is discharged to a first discharge location of the discharge unit in the sheet discharge step, discharging, to a second discharge location different from the first discharge location, a sheet subsequent to the sheet discharged to the first discharge location.

The present invention in its first aspect provides a non-transitory computer-readable storage medium storing a program for causing a computer to execute a printing step of executing a print operation to print an image on a sheet, a sheet discharge step of discharging, to a discharge unit, the sheet bearing the image printed by the print operation executed in the printing step, a sample printing control step of, according to accept a sample printing request during the print operation executed in the printing step, controlling to execute sample printing in the printing step, and discharge a page obtained by the sample printing to a discharge destination different from the discharge unit, and a discharge control step of, according to accept the sample printing request during a print operation during which a sheet is discharged to a first discharge location of the discharge unit in the sheet discharge step, discharging, to a second discharge location different from the first discharge location, a sheet subsequent to the sheet discharged to the first discharge location.

According to the present invention, the user can easily recognize a sheet among stacked sheets that has undergone sample printing in discharge.

Further features of the present invention will become apparent from the following description of exemplary embodiments with reference to the attached drawings.

DESCRIPTION OF THE EMBODIMENTS

Figure 1:
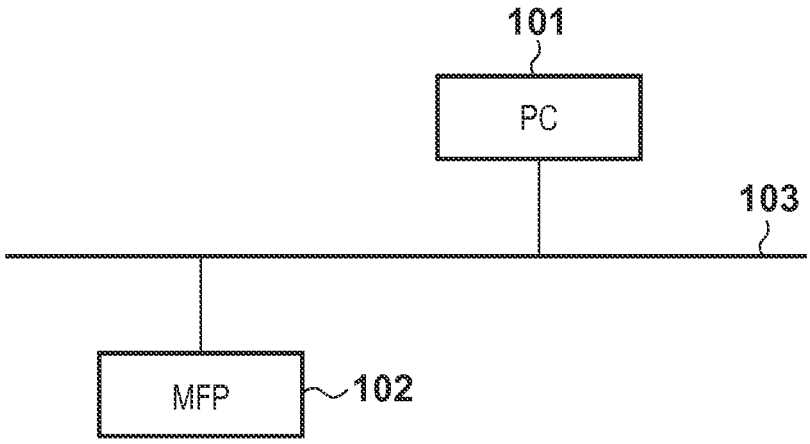
FIG. 1 is a block diagram showing the network configuration of a system.

Preferred embodiments of the present invention will now be described hereinafter in detail, with reference to the accompanying drawings. It is to be understood that the following embodiments are not intended to limit the claims of the present invention, and that not all of the combinations of the aspects that are described according to the following embodiments are necessarily required with respect to the means to solve the problems according to the present invention. Note that the same reference numerals denote the same parts, and a repetitive description thereof will be omitted.

First Embodiment

First, the network configuration of a printing system according to the embodiment will be described with reference to FIG. 1. A PC 101 is an external device such as a host computer. The PC 101 creates document data using an arbitrary application, and further creates print data. An MFP (Multi Function Peripheral) 102 is used in the printing system. As shown in FIG. 1, the PC 101 is connected to the MFP 102 via a network 103.

Figure 2A:
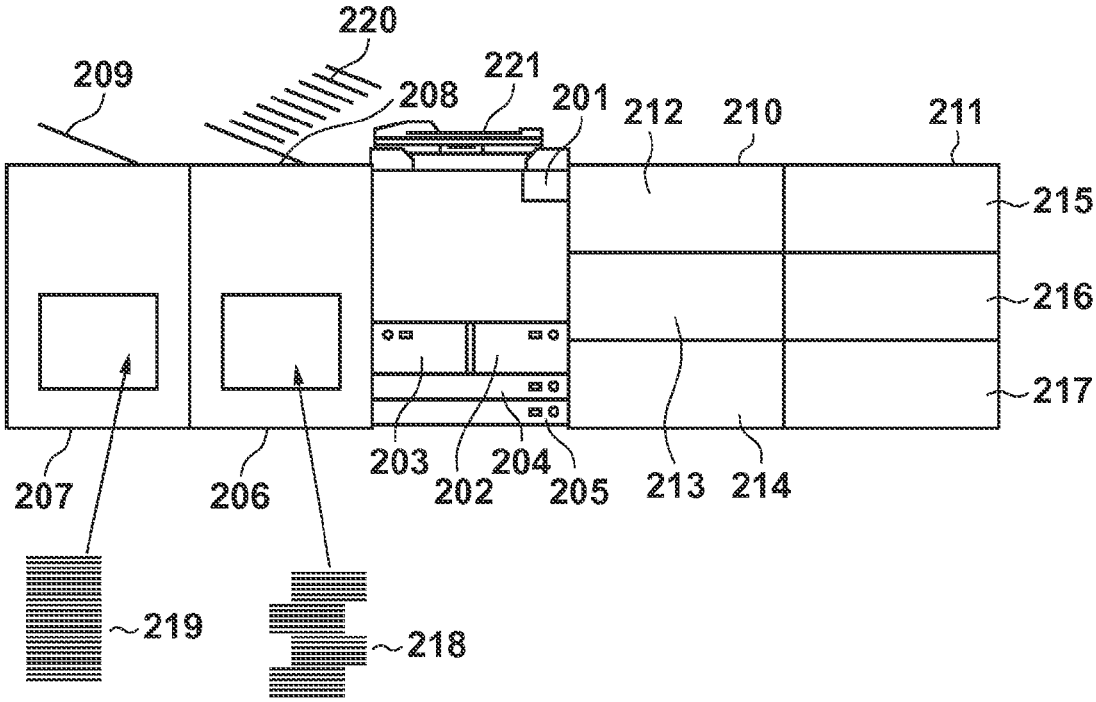
FIGS. 2A and 2B are views showing a printing apparatus and discharge position.

The MFP adopted in the embodiment will be explained with reference to FIG. 2A. An MFP 201 is the main body of the multi-function peripheral and is equivalent to the MFP 102 in FIG. 1. The MFP 201 includes paper feed cassettes 202 and 203, and sheets to be printed by the MFP 201 can be set in the paper feed cassettes 202 and 203.

The MFP 201 also includes paper feed cassettes 204 and 205 to set sheets to be printed by the MFP 201. Discharge stackers 206 and 207 are connected to the MFP 201, and can discharge a large number of sheets printed by the MFP 201 onto discharge units such as internal discharge trays in the stackers and stack them. The discharge stackers 206 and 207 can also shift sheets, discharge them onto the internal discharge trays of the stackers, and stack them.

Sample trays 208 and 209 receive sample sheets discharged from the discharge stackers 206 and 207, respectively. Paper decks 210 and 211 are arranged beside the MFP 201. Sheets to be printed by the MFP 201 can be set in the paper deck 210.

The paper deck 210 includes paper feed cassettes 212, 213, and 214 in which sheets to be printed by the MFP 201 can be set. Similarly, the paper deck 211 includes paper feed cassettes 215, 216, and 217 in which sheets to be printed by the MFP 201 can be set.

A shift bundle 218 is a sheet bundle which is discharged and stored in the discharge stacker 206. The shift bundle 218 exemplifies a state in which a discharged bundle is discharged and stored while shifting three times at two discharge positions. A sheet bundle 219 is discharged and stored in the discharge stacker 207. The sheet bundle 219 exemplifies a state in which a discharged bundle is stored without shifting it. In the embodiment, printing of the shift bundle 218 and sheet bundle 219 respectively discharged onto the discharge stackers 206 and 207 will be called normal printing.

Printed materials 220 are discharged onto the sample tray 208. Note that the printed material 220 discharged onto the sample tray 208 will be called a sample print. An automatic document feeder & reader 221 includes an automatic document feeder and reader for reading a document.

Figure 2B:
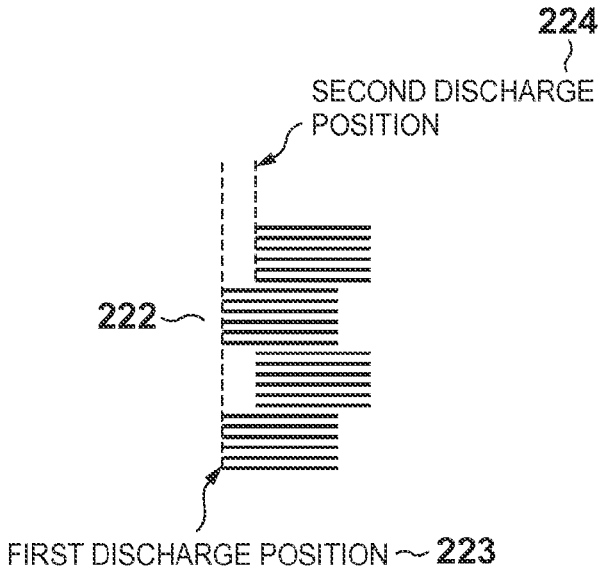

A shift bundle 222 in FIG. 2B is an enlargement of the shift bundle 218 which is discharged and stored in the discharge stacker 206. A first discharge position 223 (example of the first discharge location) and a second discharge position 224 (example of the second discharge location) are discharge positions where printed sheets are stacked within the discharge stacker 206. For descriptive convenience, the embodiment defines two discharge positions, but more than two discharge positions may be defined. The discharge stacker 206 is exemplified as the discharge location (discharge stacker), but the discharge location is not limited to one discharge stacker. For example, a plurality of discharge stackers may be prepared. When performing sample printing, the discharge stacker serving as the discharge destination is changed from the first discharge stacker (example of the first discharge location) to the second discharge stacker (example of the second discharge location). In this manner, the discharge apparatus itself may be changed.

Each device in the printing system will be explained with reference to FIG. 3. A PC 301 is a host computer and corresponds to the PC 101 in FIG. 1. Document data 302 is data which is created by an application (not shown) installed in the PC 301. The document data is data created by a document creation application (not shown). Note that the PC 301 includes a CPU, ROM, and RAM (none of them are shown). The CPU comprehensively controls the PC 301 by reading out and executing a program stored in the ROM.

A printer driver 303 creates PDL (Page Description Language) data from the document data 302. A storage area 304 stores the document data 302, the printer driver 303, an application (not shown) for creating the document data 302, and the like. Upon receiving a transmission instruction from the user, the PC 301 transmits, to an MFP 306 via a communication interface 305, PDL data created by the printer driver 303.

The MFP 306 is equivalent to the MFP 102 in FIG. 1. A communication interface 307 receives PDL data or the like transmitted from the PC 301. A data reception unit 308 stores the PDL data received via the communication interface 307.

An interpreter 309 interprets the PDL data received by the data reception unit 308. Assume that the interpreter 309 can interpret PDL formats such as PS, PCL, and LIPS. Needless to say, the interpreter 309 may be able to interpret a format other than PDL.

Intermediate data 310 is obtained when PDL data (not shown) received by the data reception unit 308 is interpreted by the interpreter 309 and converted. A renderer 311 analyzes the intermediate data 310 and converts it into image data. An image data storage unit 312 is formed from a RAM or HDD, and stores image data obtained as the processing result of the renderer 311.

A printer engine 313 converts the image data stored in the image data storage unit 312 into a video signal, and prints. A scanner 314 scans a document. The image scanned by the scanner 314 is stored as image data in the image data storage unit 312. A storage unit 315 is formed from an HDD or the like, and is used to store the processing results of the data reception unit 308 and interpreter 309. A control unit 316 comprehensively controls the MFP. The control unit 316 is formed from a CPU, ROM, and RAM (none of them are shown). The CPU reads out and executes a program stored in the ROM, thereby performing various control operations such as image processing control and sample printing control in the MFP 102, and discharge control by a post-processing apparatus connected to the MFP 102. The RAM functions as a work area for the CPU. Various processing instructions are issued in the embodiment. A UI screen 317 is a user interface for operating the MFP 306.

The user interface will be described with reference to FIG. 4. A user interface 1001 is the entire user interface screen. The user interface 1001 represents details of the printer driver 303 in FIG. 3 or those of the UI screen 317 in FIG. 3, and the same settings can be made on them. In the embodiment, printing based on PDL data uses the printer driver 303, and printing using the copy function uses the UI screen 317. Note that the screen shown in FIG. 4 may be the standard screen of the printer driver 303 or UI screen 317, or may appear when the user presses a Special Features key on the standard screen.

A print setting screen 1002 is used to select print settings. A copy count input field 1003 is used to input the copy count in normal printing. In the embodiment, a numerical value of 1 to 100,000 can be set in the copy count input field 1003. A designation field 1004 is used to designate a discharge destination for discharging sheets in normal printing. The embodiment assumes that the discharge stacker 206 or 207 is designated.

A sample printing function setting field 1006 is used to set whether to execute the sample printing function (check printing function). Either ON or OFF can be input to the sample printing function setting field 1006. Setting ON in the sample printing function setting field 1006 validates sample printing (to be also referred to as check printing) at an arbitrary timing by the user in the embodiment, or cyclic sample printing in the second embodiment (to be described later).

A sample printing shift field 1005 is used to set whether to shift the discharge position of a printed material obtained by normal printing when sample printing is performed. When ON is selected in the sample printing shift field 1005, the discharge position of a printed material obtained by normal printing is changed upon sample printing. When OFF is selected in the sample printing shift field 1005, the discharge position of a printed material obtained by normal printing is not changed even upon sample printing.

In addition to the sample printing shift field, a normal printing shift field may be provided. The normal printing shift field is a setting field used to set whether to shift and discharge a printed material every time a condition that a normal printing page has been printed by a predetermined number of copies is satisfied. When the user sets ON in the normal printing shift field, the printed material discharge position is changed every time, for example, five copies are printed. When the user sets OFF in the normal printing shift field, no printed material discharge position is changed.

It is preferable to set OFF in the normal printing shift field when ON is selected in the sample printing shift field 1005. That is, it is preferable to restrict execution of both discharge location change control using the sample printing shift function and discharge location change control using the normal printing shift function. This can prevent the coexistence of a shift generated by the normal printing shift function and a shift generated by the sample printing shift function. The user can more easily recognize a shift generated by the sample printing shift function.

A sample printing discharge cycle field 1007 is used in the second embodiment (to be described later) to cyclically discharge a sample print. The second embodiment assumes that a numerical value of 1 to 100,000 can be set in the sample printing discharge cycle field 1007. In the first embodiment, the sample printing discharge cycle field 1007 need not be set and thus may not be displayed.

A discharge destination designation field 1008 is used to designate a discharge destination to which a printed material obtained by sample printing is discharged. The embodiment assumes that the sample tray 208 or 209 is set.

Figure 5:
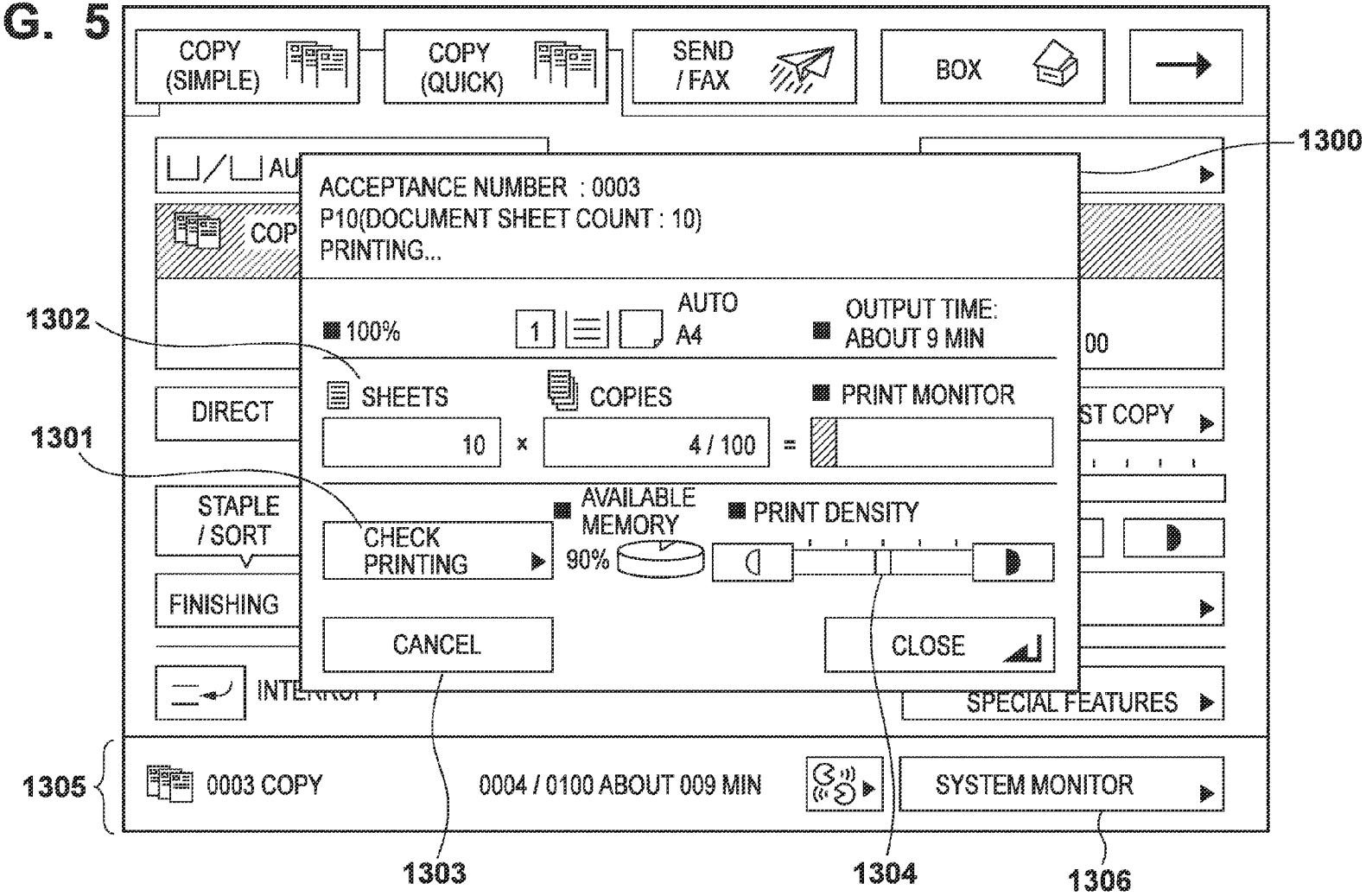
FIG. 5 is a view exemplifying a screen displayed during printing.

FIG. 5 is a view showing a screen displayed on the UI screen 317 of the MFP 201 during printing. A popup screen 1300 represents a printing status. A check printing button 1301 is used to accept a check printing instruction from the user. A display 1302 represents the printing sheet count, the copy number during printing, and a status bar indicating the progress of overall printing. A cancel button 1303 is used to cancel printing. A slider 1304 is used to adjust the print density. A status line 1305 represents a printing status. A system monitor button 1306 is used to confirm a queued job. Note that the same screen as the popup screen 1300 may be displayed on the display unit of the PC 301.

The first embodiment will explain a case in which the user presses the check printing button 1301 at an arbitrary timing during a printing operation to output a sample print.

Figure 6:
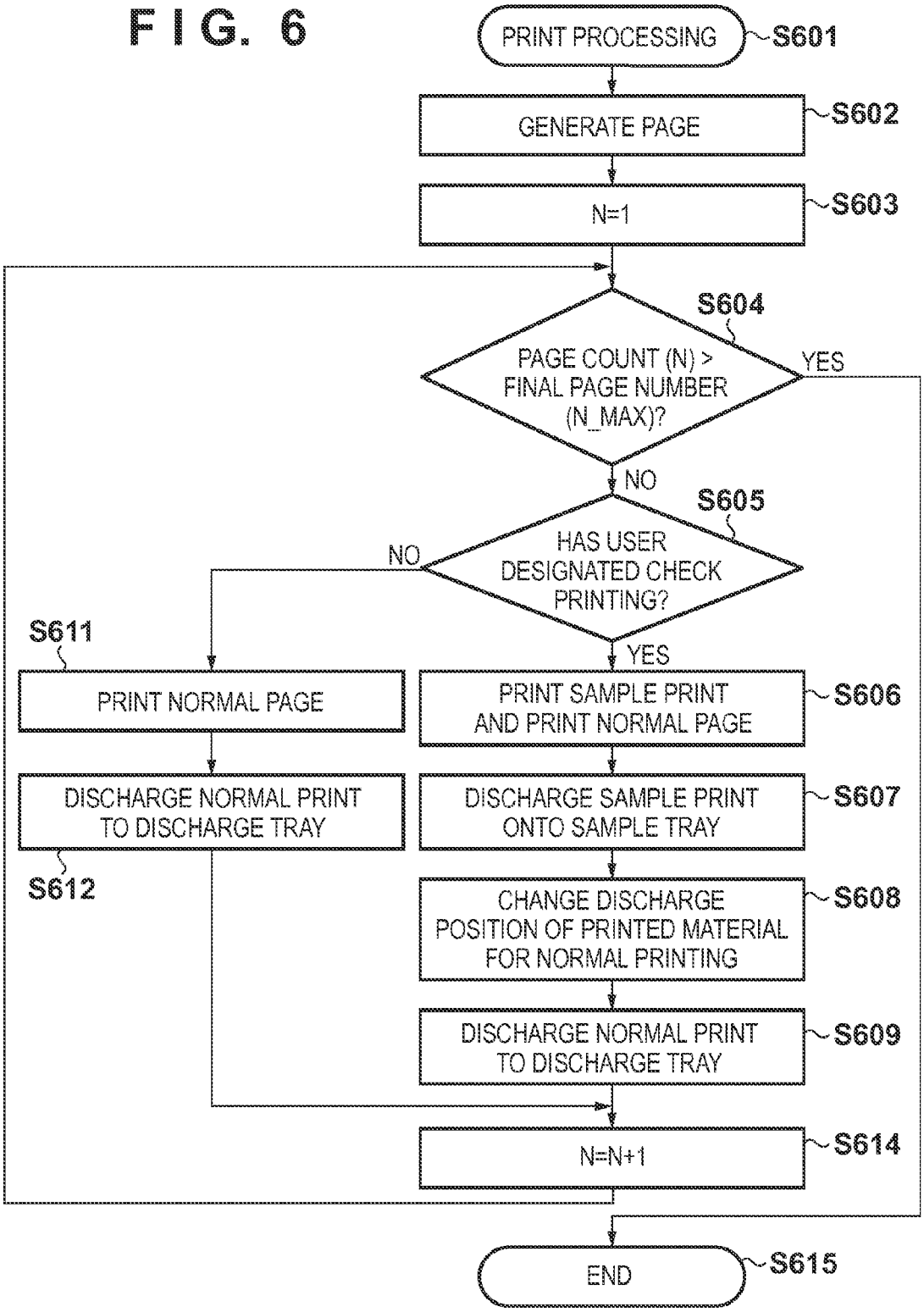
FIG. 6 is a flowchart showing print processing according to the first embodiment.

FIG. 6 is a flowchart showing print processing by the control unit 316 according to the first embodiment. Respective steps shown in the flowchart of FIG. 6 are performed by reading out and executing a program stored in the ROM by the CPU of the control unit 316.

In step S601, upon receiving a print job, the control unit 316 starts print processing for the print job. In step S602, the control unit 316 performs page generation using the interpreter 309, renderer 311, and image data storage unit 312. This page generation generates image data in which pages are formed. The control unit 316 counts the number of pages of the generated image data as N_MAX. Details of the page generation will be explained with reference to the flowchart of FIG. 8 (to be described later). In the following description, the page generation processing is executed parallelly to processes in step S603 and subsequent steps. However, the process may advance to step S603 after the end of generating image data of all pages of the received print job.

In step S603, the control unit 316 initializes a variable N indicating the page count to N=1.

In step S604, the control unit 316 determines whether the page count N during processing has exceeded the count N_MAX of pages to be printed by the print job. If the control unit 316 determines that the page count N has not exceeded the page count N_MAX, an unprocessed page remains and the control unit 316 advances the process to step S605. If the control unit 316 determines that the page count N has exceeded the page count N_MAX, no unprocessed copy remains and the control unit 316 advances the process to step S615.

In step S605, the control unit 316 determines whether the user has pressed the check printing button in the screen shown in FIG. 5 to accept a sample printing request from the user. If the control unit 316 determines that the user has pressed the check printing button 1301, it advances the process to step S606; if NO, to step S611.

In step S606, the control unit 316 performs print processing for a normal page, and print processing of sample printing subsequently to the print processing for the normal page. The control unit 316 can execute these processes by video-transferring twice, to the printer engine 313, image data stored in the image data storage unit 312. First, the control unit 316 transfers image data to the printer engine 313 for printing of a sample page, and controls the printer engine 313 to print a sample printing page. Then, the control unit 316 transfers the image data to the printer engine 313 for printing of a normal page, and controls the printer engine 313 to print a normal printing page. In this example, when the user presses the check printing button 1301 during printing of the fifth printed material, sample printing is executed for the sixth printed material. However, the present invention is not limited to this. When the user presses the check printing button 1301 during printing of the fifth printed material, sample printing may be executed for the fifth printed material after printing the fifth printed material.

Figure 4:
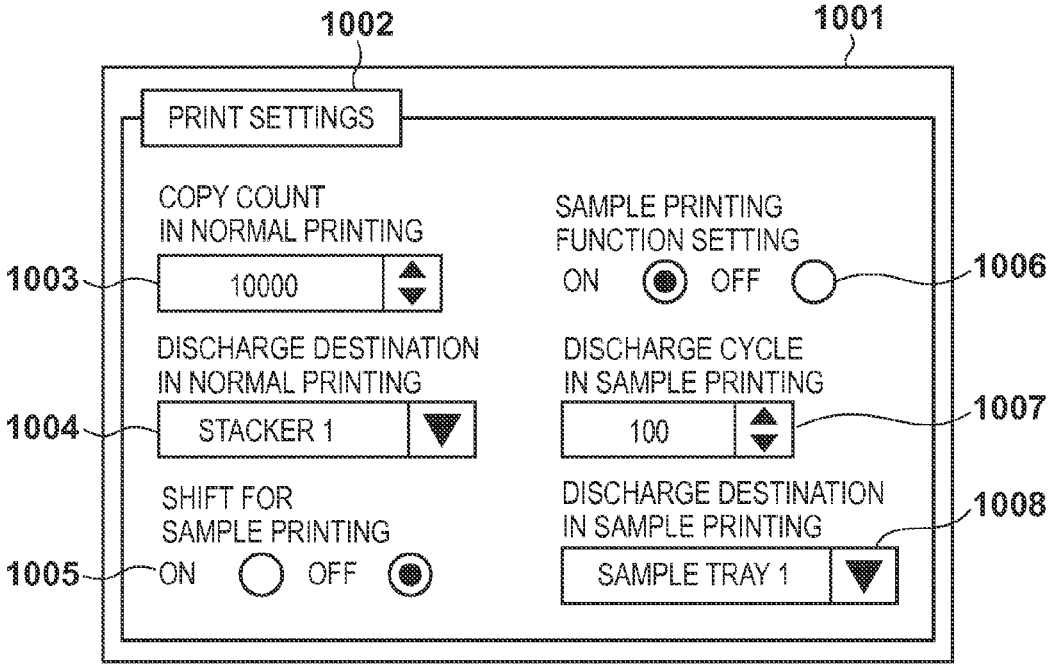
FIG. 4 is a view exemplifying the screen of a user interface.

In step S607, the control unit 316 discharges the printed material of the sample printing page to sample tray 1 in accordance with the discharge destination setting in the discharge destination designation field 1008 by the user in FIG. 4.

In step S608, the control unit 316 changes the discharge position of normal pages discharged on stacker 1 designated as the normal page discharge destination. For example, the control unit 316 sets to shift a printed material by 15 mm from the printed materials of previous pages.

In step S609, the control unit 316 discharges the printed material of a normal printing page at the discharge position changed in step S608. The discharged sheet is stacked on stacker 1 with a shift of 15 mm from the previously discharged sheet bundle. Even after subsequent printed materials are stacked on stacker 1, the user can easily recognize the position to which a sample printing page is discharged after printing. That is, the user can easily specify, from a shift of sheets, a position where sample printing was executed in sheets stacked on stacker 1 after normal printing.

If the process advances to step S611, the control unit 316 performs print processing for a normal page. This print processing is executed by video-transferring, to the printer engine 313, image data stored in the image data storage unit 312.

In step S612, the control unit 316 discharges the printed material of the normal page obtained in step S611 to the same discharge position as that of an immediately preceding sheet on the discharge stacker 206 in accordance with the discharge destination setting of normal printing. In step S614, the control unit 316 increments the page count N during processing (N=N+1). The control unit 316 repeats steps S604 to S614 until it determines in step S604 that the page count N during processing has exceeded the page count N_MAX. If the control unit 316 determines in step S604 that the page count N during processing has exceeded the page count N_MAX, print processing ends in step S615.

As described above, according to the first embodiment, the user can designate check printing during printing to execute check printing by the MFP 102. Even after executing check printing, the MFP 102 continues subsequent print processing, suppressing a decrease in productivity. Further, the user can confirm a shift of printed materials discharged to the normal printing discharge destination and easily specify later the timing when check printing was executed. The embodiment has exemplified printing of one copy of printed materials. When printing a plurality of copies of printed materials, it suffices to repetitively execute steps S603 to S614 by a plurality of copies.

Second Embodiment

In the first embodiment, when the user sets a sample printing timing and a sample print is discharged, he is notified of the sample printing timing by shifting discharged normal printed materials. In the second embodiment, before the start of printing, the user sets the timing when sample printing is automatically executed during discharge of normal printed materials. Based on the setting, discharge of sample printing and that of normal printing are shifted.

Figure 3:
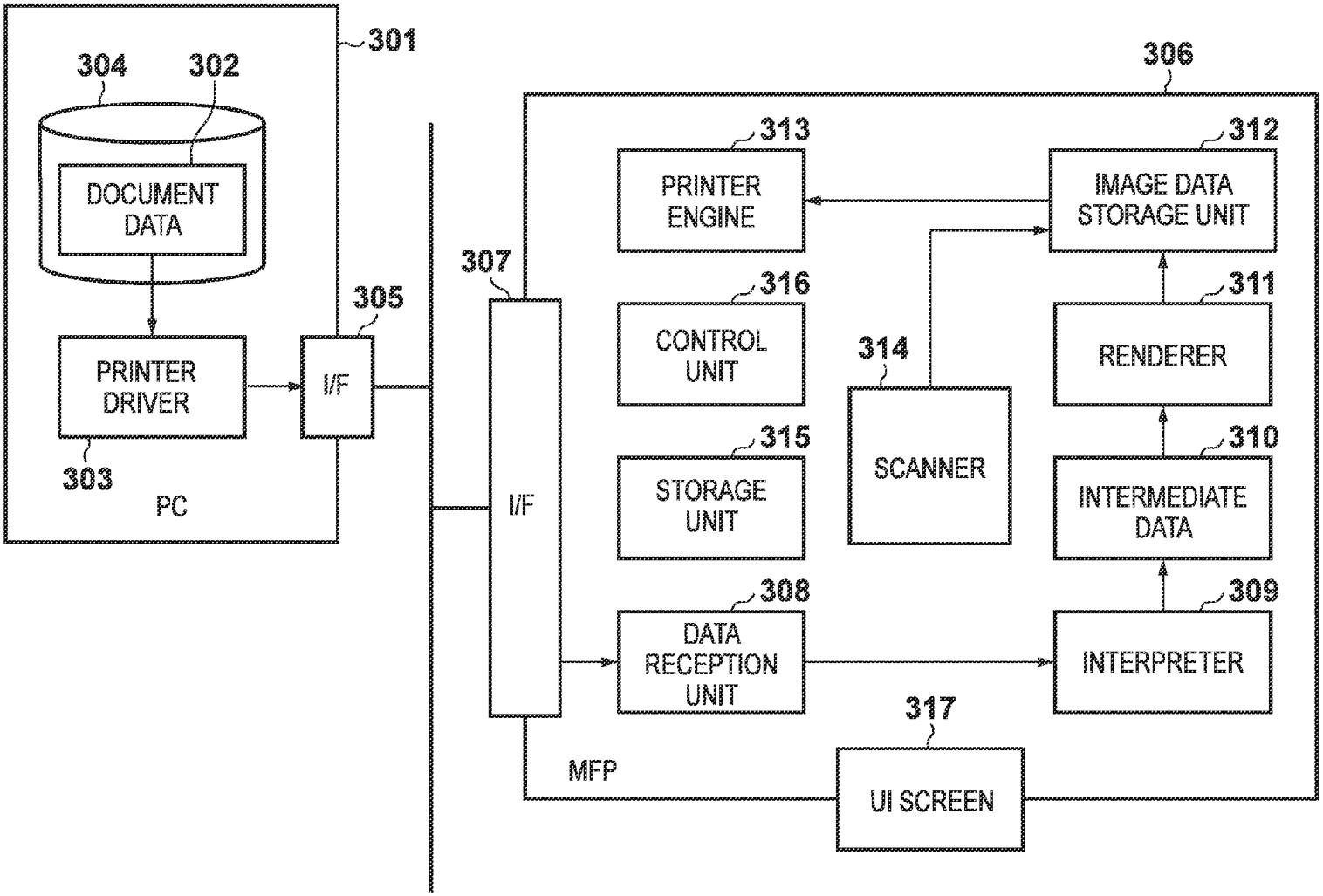
FIG. 3 is a block diagram showing the arrangement of a printing apparatus.

A printing system in the second embodiment has the same arrangements as those shown in FIGS. 1 to 3 in the first embodiment. A user interface in the second embodiment has almost the same arrangement as that shown in FIG. 4. The user interface in the second embodiment is different from the user interface in the first embodiment in that a sample printing discharge cycle field 1007 is provided. The sample printing discharge cycle field 1007 is used to cyclically discharge a sample print. A numerical value of 1 to 100,000 can be set in the sample printing discharge cycle field 1007. An MFP 102 executes sample printing every time the number of printed materials that is indicated by a numerical value set in the sample printing discharge cycle field 1007 are printed. For example, when "100" is designated in the sample printing discharge cycle field 1007, the MFP 102 executes sample printing for the 100th printed material after printing 99 printed materials and discharging them onto stacker 1. In the same way, the MFP 102 executes sample printing for the 200th and 300th printed materials.

A screen displayed during printing is the same as the screen example of FIG. 5 in the first embodiment.

Figure 7:
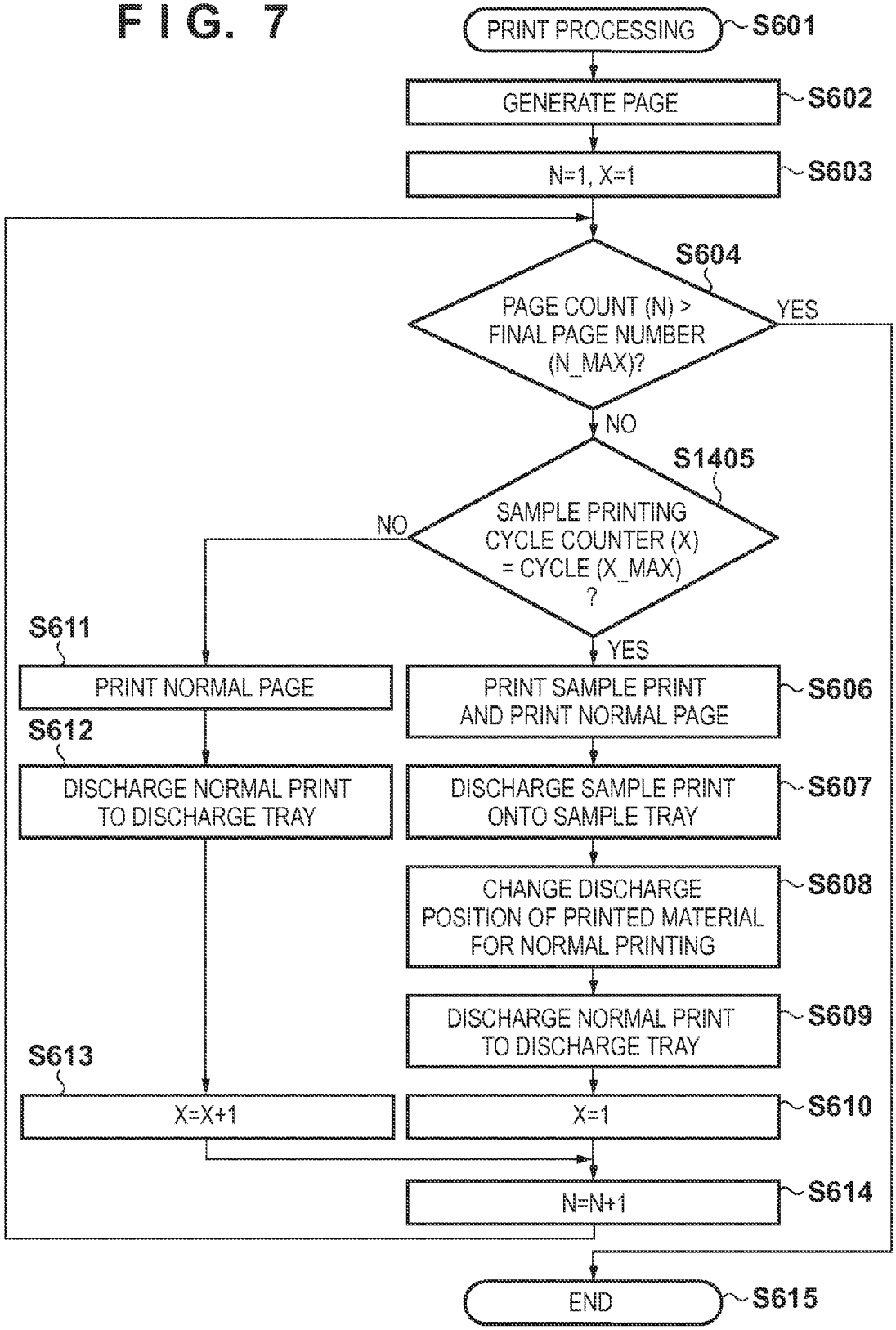
FIG. 7 is a flowchart showing print processing according to the second embodiment.

Processing according to the second embodiment will be described below. FIG. 7 is a flowchart showing the sequence of print processing according to the second embodiment. Respective steps shown in the flowchart of FIG. 7 are performed by reading out and executing a program stored in the ROM by the CPU of a control unit 316. The first embodiment has already described operations in steps S601, S602, S604, S606, S607, S609, S611, S612, S614, and S615 of FIG. 6. Thus, the remaining steps S603, S604, S1405, S610, and S613 will be explained below.

In step S603, the control unit 316 initializes a variable N indicating the page count and a variable X indicating the sample printing cycle counter to N=1 and X=1, respectively. In this case, the control unit 316 sets a value set in the sample printing discharge cycle field 1007 as X_MAX indicating the cyclic page count.

In step S604, the control unit 316 determines whether the page count N during processing has exceeded the count N_MAX of pages to be printed by the print job. If the page count N has not exceeded the page count N_MAX, the control unit 316 determines that an unprocessed page remains, and advances to step S1405. If the page count N has exceeded the page count N_MAX, the control unit 316 determines that no unprocessed copy remains, and advances to step S615.

In step S1405, the control unit 316 compares the sample printing cycle counter X with the sample printing cycle X_MAX and determines whether they are equal to each other. If the control unit 316 determines that the sample printing cycle counter X is equal to the sample printing cycle X_MAX, it advances the process to step S606. If the control unit 316 determines that the sample printing cycle counter X is different from the sample printing cycle X_MAX, it advances the process to step S611.

Subsequent processes up to step S610 or S613 are the same as those described in the first embodiment. If the process advances to step S610, the control unit 316 sets X=1. If the process advances to step S613, the control unit 316 increments X. By this control, the MFP 102 automatically executes sample printing for every sheet count designated by the user. When sample printing is executed, the MFP 102 prints after changing the discharge position of the printed material of a normal printing page. The user can see a printed material obtained by sample printing and regularly check the print quality. Also, the user can confirm a shift of printed materials discharged to the normal printing discharge destination and easily specify later the timing when check printing was executed. In the embodiment, a discharge stacker 206 is exemplified as the discharge location. However, the discharge location is not limited to one discharge stacker, similar to the first embodiment. For example, a plurality of discharge stackers may be prepared. Every time sample printing is done, the discharge stacker is changed in turn to identify the printed sheet stacking position. Also in this case, the same effect as a shift within one stacker can be obtained.

Figure 8:
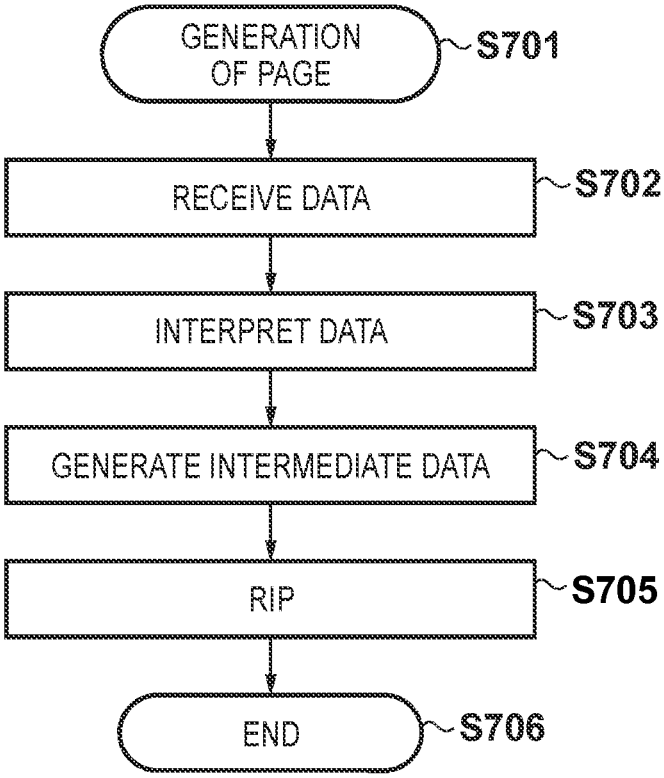
FIG. 8 is a flowchart showing page generation processing.

Page generation processing (processes in step S602 of FIG. 6 and step S602 of FIG. 8) in the first and second embodiments will be explained with reference to the flowchart of FIG. 8. Respective steps shown in the flowchart of FIG. 8 are performed by reading out and executing a program stored in the ROM by the CPU of the control unit 316.

In step S701, the control unit 316 starts page generation processing. In step S702, the control unit 316 controls a data reception unit 308 in FIG. 3 to receive PDL data (not shown) which has been created by a printer driver 303 based on document data of an application (not shown) in a PC 101. In step S703, the control unit 316 controls an interpreter 309 to interpret the PDL data received in step S702.

In step S704, the control unit 316 converts the print data interpreted by the interpreter 309 into intermediate data. The intermediate data contains a rendering object such as "bitmap", "run length", "trapezoid", "box", or "high-speed boundary-coded bitmap", and a background pattern. The intermediate data is a general term of rendering logic when rendering these data in a raster memory.

In step S705, the control unit 316 RIPs generated intermediate data 310. RIP is to convert the intermediate data 310 into image data by the renderer 311 and store the image data in an image data storage unit 312. Then, preparations to print a normal printing page are completed, and page generation processing ends in step S706.

As described above, the second embodiment has exemplified PDL printing in which the MFP 102 analyzes a print job received from the PC 301 to generate image data, and the printer engine 313 prints. However, the present invention is not limited to this and may be applied to copying as follows. More specifically, the flowchart of FIG. 8 in the second embodiment is replaced with that of FIG. 9. Respective steps shown in the flowchart of FIG. 9 are performed by reading out and executing a program stored in the ROM by the CPU of the control unit 316.

Figure 9:
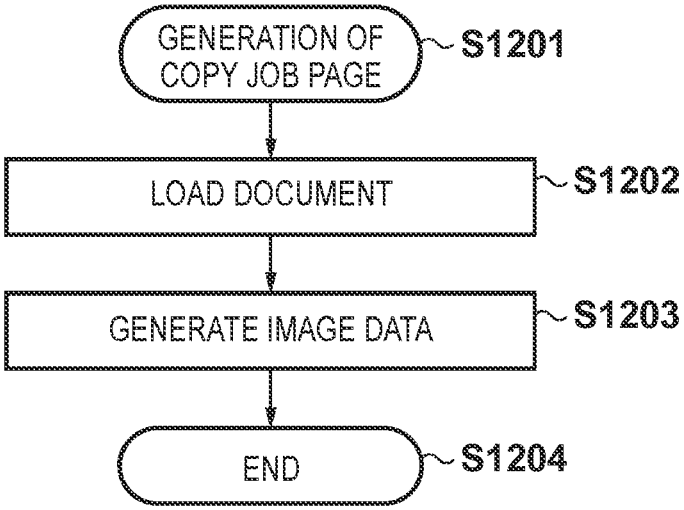
FIG. 9 is a flowchart showing copy job page generation processing.
Figure 10:
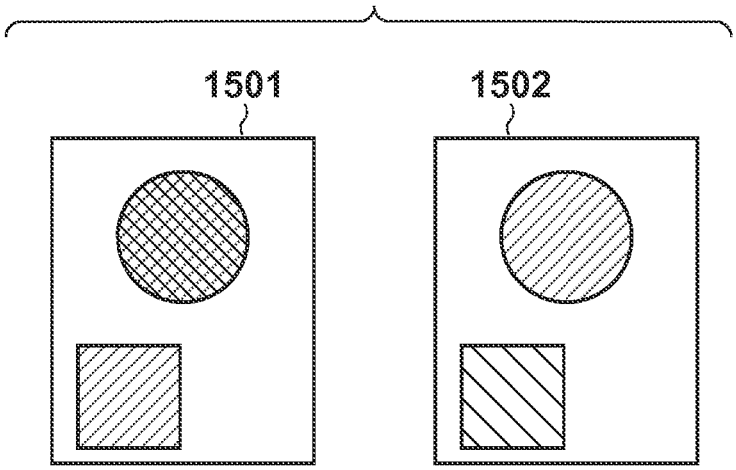
FIG. 10 is a view exemplifying an output sample print.

In step S1201 of FIG. 9, the control unit 316 starts copy job page generation processing. When the user sets a document on an automatic document feeder 221, the control unit 316 executes loading of the set document in step S1202. The control unit 316 controls the automatic document feeder 221 to feed the document to a scanner 314, and the scanner 314 to scan the document. In step S1203, the control unit 316 converts the scanned document into image data, and stores the image data in the image data storage unit 312. Subsequent processes are the same as those in step S603 and subsequent steps. When the present invention is applied to copying, it suffices to display the screen shown in FIG. 4 on a UI screen 317 of the MFP 102.

Other Embodiments

Aspects of the present invention can also be realized by a computer of a system or apparatus (or devices such as a CPU or MPU) that reads out and executes a program recorded on a memory device to perform the functions of the above-described embodiment(s), and by a method, the steps of which are performed by a computer of a system or apparatus by, for example, reading out and executing a program recorded on a memory device to perform the functions of the above-described embodiment(s). For this purpose, the program is provided to the computer for example via a network or from a recording medium of various types serving as the memory device (for example, computer-readable medium).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-206139, filed Sep. 14, 2010, which is hereby incorporated by reference herein in its entirety.

What is claimed is:

1. A printing apparatus comprising:

a printing unit configured to print an image on a sheet;

a sheet discharge unit configured to discharge, to a first discharge unit, the sheet on which an image is printed by said printing unit;

an accepting unit configured to accept a sample printing request;

a sample printing control unit configured to, when said accepting unit accepts the sample printing request, control said printing unit to print a sample image on a sample sheet, and discharge the sample sheet to a second discharge unit which is different from the first discharge unit; and a discharge control unit configured to change discharge position of the first discharge unit to which the sheet is discharged by said sheet discharge unit when the sample image is printed in a first mode, and not to change discharge position of the first discharge unit to which the sheet is discharged by said sheet discharge unit when the sample image is printed in a second mode.

2. The apparatus according to claim 1, further comprising a setting unit configured to set a condition to execute the sample printing, wherein said sample printing control unit controls said printing unit to print the sample image on the sample sheet in accordance with the condition set by said setting unit, and discharge the sample sheet to the second discharge unit.

3. The apparatus according to claim 1, wherein said discharge control unit changes discharge position from a first discharge position to a second discharge position different from the first discharge position, wherein the first and second positions are in a single discharge apparatus.

4. The apparatus according to claim 1, wherein said discharge control unit changes discharge position from a first discharge position to a second discharge position different from the first discharge position, wherein the first and second positions are respectively in different discharge apparatuses.

5. The apparatus according to claim 1, further comprising:

a discharge position change unit configured to change a-sheet discharge position every time said printing unit prints a predetermined number of copies; and a restriction unit configured to restrict execution of both change of discharge position by said discharge control unit and change of discharge position by said discharge position change unit.

6. A method of controlling a printing apparatus, comprising:

a printing step of printing an image on a sheet;

a sheet discharge step of discharging, to a first discharge unit, the sheet on which an image is printed in the printing step;

an accepting step of accepting a sample printing request;

a sample printing control step of, when said accepting step accepts the sample printing request, controlling to print a sample image on a sample sheet in the printing step, and discharge the sample sheet to a second discharge unit which is different from the first discharge unit; and a discharge control step of changing discharge position of the first discharge unit to which the sheet is discharged in the sheet discharge step when the sample image is printed in a first mode, and not changing discharge position of the first discharge unit to which the sheet is discharged in the sheet discharge step when the sample image is printed in a second mode.

7. A non-transitory computer-readable storage medium storing a program for causing a computer to execute:

a printing step of printing an image on a sheet;

a sheet discharge step of discharging, to a first discharge unit, the sheet on which an image is printed in the printing step;

an accepting step of accepting a sample printing request;

a sample printing control step of, when said accepting step accepts the sample printing request, controlling to print a sample image on a sample sheet in the printing step, and discharge the sample sheet to a second discharge unit which is different from the first discharge unit; and a discharge control step of changing discharge position of the first discharge unit to which the sheet is discharged in the sheet discharge step when the sample image is printed in a first mode, and not changing discharge position of the first discharge unit to which the sheet is discharged in the sheet discharge step when the sample image is printed in a second mode.

8. The apparatus according to claim 1, wherein the sample printing request is accepted while an printing operation is executed by said printing unit.

* * * * *